US005971689A

United States Patent [19]

Scharer et al.

[11] Patent Number: 5,971,689

[45] Date of Patent: Oct. 26, 1999

[54] BINDING MACHINE WITH PIVOTAL COMB MEMBER

[75] Inventors: Roger R. Scharer, Oxford, Mich.; Thomas T. Battisti, Buffalo Grove; John Geisert, Palatine, both of Ill.

[73] Assignee: General Binding Corp., Northbrook, Ill.

[21] Appl. No.: 08/953,058

[22] Filed: Oct. 17, 1997

[51] Int. Cl.[6] ..... B42C 13/00

[52] U.S. Cl. ..... 412/33; 412/34; 412/39; 412/20

[58] Field of Search ..... 412/20, 21, 33, 412/34, 38, 39, 40, 42, 9

[56] References Cited

U.S. PATENT DOCUMENTS

| | | | |
|---|---|---|---|
| 4,645,399 | 2/1987 | Scharer | 412/40 |
| 4,820,099 | 4/1989 | Battisti . | |
| 4,872,796 | 10/1989 | Hseih et al. | 412/40 |
| 5,211,522 | 5/1993 | Ho | 412/40 |
| 5,419,668 | 5/1995 | Battisti . | |
| 5,827,034 | 10/1998 | Von Rohrscheidt . | |

FOREIGN PATENT DOCUMENTS

| | | |
|---|---|---|
| 0 727 327 | 8/1996 | European Pat. Off. . |
| 195 05 191 | 8/1996 | Germany . |
| 296 22 727 U | 6/1997 | Germany . |

OTHER PUBLICATIONS

Combman Ibico Desktop Comb Binder.

*Primary Examiner*—Andrea L. Pitts
*Assistant Examiner*—Rouzbeh Tabaddor
*Attorney, Agent, or Firm*—Leydig, Voit & Mayer

[57] ABSTRACT

A binding machine is operable to hyper-deflect the rings of a binding element against non-planar surfaces to achieve an advantageously forward presentation of free ends of the rings for ergonomic and convenient insertion of a perforated stack of sheets. An embodiment of the binding machine has a base, a plurality of stationary hooks fixed to the base, and a comb member which is pivotally mounted to the base. The comb member may be fixed to a shroud which is mounted to effect the pivotal movement of the comb member. Additionally, this shroud may be axially shifted. When the binding element is supported against the comb member, the axial and pivotal motions of shroud respectively cause (1) engaging of rings of the binding element with the stationary hooks and (2) uncurling deflection of the rings.

23 Claims, 9 Drawing Sheets

BINDING MACHINE WITH PIVOTAL COMB MEMBER

FIELD OF THE INVENTION

The present invention generally relates to binding machines, and more particularly relates to a binding machine mechanism having coacting comb and hook members for spreading the rings of a plastic binder element.

BACKGROUND OF THE INVENTION

Books, papers and documents are often bound by a plastic binding element which has a spine and a plurality of flexible curl-shaped plastic rings. The rings extend through a series of holes punched along a common side of the pages of the stock. It is known to apply these plastic binders to a perforated stack by using a conventional binding machine that spreads open the binding element to uncurl the rings, permitting the stack to be assembled with the binder by inserting the rings through respective perforations in the stack.

A conventional binding machine typically includes a plurality of movable L-shaped hooks and a non-pivotal, stationary comb member with a plurality of spaced tines. The spine of the binding element is supported against the comb member so that the tines of the comb are alternatingly positioned between the rings of the binding element. While the stationary comb member holds the spine of the binding element, the hooks move in unison to cooperatively engage an inner side of the curled rings and then uncurl the rings away from the spine, spreading open the binding element.

Such a binding machine having a stationary comb member employs a conventional binding mechanism which moves the hooks through predetermined planar motions. In particular, the conventional binding mechanism moves hooks as follows: (1) the hooks first shift in unison in an axial direction (parallel to the comb member and the binding element) to individually engage respective rings of the binding element; and then (2) the hooks move in unison perpendicularly away from the comb member to pull and deflect the rings. These deflected rings are "uncurled" together until their free ends are accessible to be inserted through the series of punched perforations in the stack of pages.

In order to achieve the desired hook motion relative to the stationary comb member, a prior art binding mechanism typically has a flat plate drivable to slide under a planar work surface adjacent the stationary comb member, so that the plate is moveable in a plane parallel to the work surfaces. The hooks are fixed to the moveable plate, extending upwardly through a series of grooves in the work surface. Because the hooks are fixed to move with the sliding plate, the hooks have a planar movement from a position near the comb element, shifting axially and then sliding transversely away from the comb element. After the punched pages are assembled onto the rings, the described conventional hook motion is reversed, permitting the rings to curl back to their original shape and closing the binding element. Such a conventional binding machine having a stationary comb and planar-movable hooks is disclosed in U.S. Pat. No. 5,419,668, incorporated herein by reference in its entirety.

To cause the axial shift of the hooks for engaging and releasing the rings, the conventional binding mechanism includes a cam device which causes the plate to slide in a L-shaped pattern, resulting in the predetermined shifting and sliding hook motion. In another known binding machine, the comb member is axially shifted to move the binder rings into an engaged relation with the hooks, and the hooks are then linearly moved to spread open the rings of the binding element.

Binding machines are also known which have a stationary comb and rotary-moving hooks that uncurl the rings of a binding element against a stationary cylindrical-shaped surface.

Certain problems can arise with the described movable-hook style binding machines. Firstly, such machines can be complicated to manufacture because numerous parts are required to cause the planar hook motion. Secondly, the linear pulling motion of the hooks which uncurls the rings can sometimes cause an uneven degree of uncurling of rings along the length of the binder. This is known as "hook skew" which undesirably results in non-uniform or non-linear alignment of the free ends of the rings. This makes the insertion of the punched stack onto the rings difficult. Thirdly, the typical planar motion of the hooks uncurls the rings so that a linearly deflected portion of each ring is forced to lie flatly against the planar unrolling surface. Because of the rearward curvature of relaxed portions of the rings, their the free ends tend to angle rearwardly, and therefore, a substantial length of each ring must be flatly uncurled in order to achieve a suitable angle for accessing the free ends.

It is, therefore, an object of the present invention to provide a binding machine that is easy to use and which minimizes nonuniform opening of a binding element.

A further object of the invention is to provide a binding machine that has few parts which is easy to manufacture and assemble.

SUMMARY OF THE INVENTION

The present invention achieves the aforementioned objects by providing an improved binding machine with a new binding mechanism which uncurls portions of the rings of a binding element in a hyper-deflected manner so that the binding element is opened with an enhanced forwardly-presented motion of the free ends, providing improved spine clearance for convenient loading of perforated pages. In particular, binding mechanism is operable to elastically deflect a portion each rings to have a curvature opposite of its relaxed curvature or normal curled state.

The invention provides various structures for achieving this improved ring-opening deflection behavior. According to the invention, a binding machine structure is provided which moves the comb member away from the hooks with an arcuate motion, such as a rotary or pivotal motion, causing the rings to uncurl against a non-planar surface.

In a preferred embodiment, the machine includes a base, an elongate cylindrical shroud pivotally mounted to the base, and a plurality of hooks fixed to the base. The comb member is fixed to the pivotal shroud, and the stationary hooks extend upwardly through slots in the shroud to be respectively positioned near individual tines of the comb member. The shroud can be shifted axially by a cam, shifting a binding element fitted on the comb member so that an inner side of the rings engage under the stationary hooks. The pivotal comb movement by rotating the shroud is then operable to uncurl the rings against the non-planar shroud surface.

The shroud may be provided in a variety of non-planar overall contours, depending on the desired ring deflection behavior. Additionally, the machine can be provided in various structures, such as a machine with a comb-member that tilts rearwardly relative to the hooks, a machine with a non-planar shroud with slots through which the comb extends for relative movement, and even a machine having a linearly-movable non-planar shroud which causes the hyper-deflected, non-planar uncurling of the rings against the non-planar shroud.

Advantageously, the binding mechanism according to the invention results in improved operation, providing uniform uncurling of rings and minimizing "hook skew". The present invention also provides a binding machine which is more convenient to manually operate because the free ends of the rings are positioned more accessibly for inserting a stack of sheets. This is a result of the curved or non-planar deflection of the rings achieved by binding machine of the invention. More specifically, the contoured non-planar surface against which the rings are deflected causes the free ends to advantageously move more forwardly and upwardly when the binding machine is actuated. This free end positioning makes the insertion of perforated sheets easier than a more rearward angle produced by a conventional binding machine for the same uncurled ring length. Thus, a binding machine according to the invention is ergonomically preferred over a conventional binding machine having a generally horizontal unrolling surface.

Furthermore, the invention advantageously provides a binding machine that is reliable, easy to manufacture, and which has a minimal number of moving parts.

Additional features and advantages of the invention are described in, and will be apparent from, the detailed description of the preferred embodiments and from the drawings.

DETAILED DESCRIPTION OF THE PREFERRED EMBODIMENTS

Figure 1:
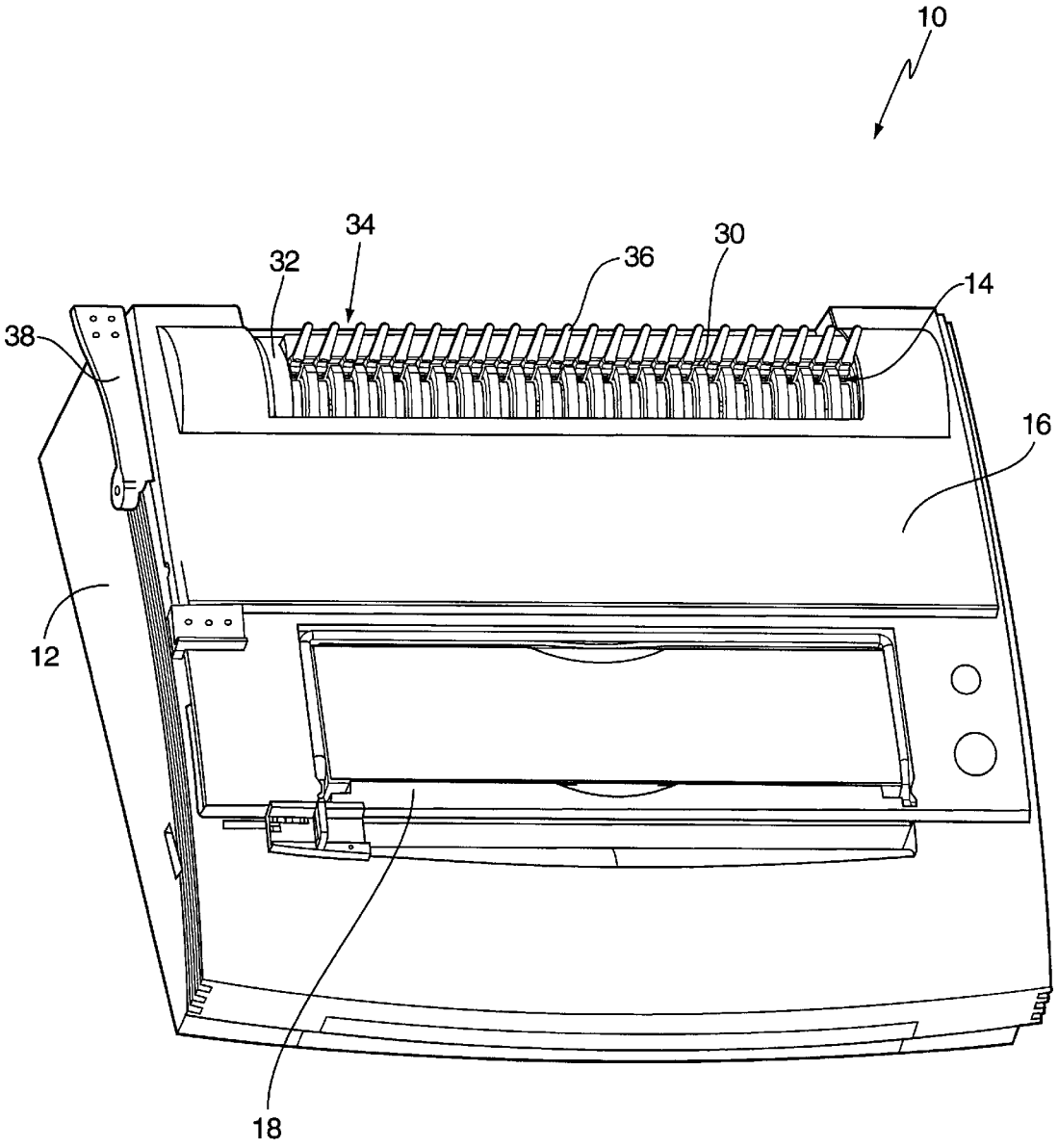
FIG. 1 is an isometric view of a binding machine constructed in accordance with teachings of the invention.

Now referring to the drawings, wherein like numerals designate like components, in FIG. 1 there is shown a binding machine 10 embodying features of the present invention. The binding machine 10 has a housing 12 adapted to rest on a work surface or tabletop (not shown). The housing 12 partially encloses a binding mechanism 14 which is mounted generally at a rearward portion of the binding machine 10. For operatively supporting a stack of sheets (not shown) adjacent to the binding mechanism 14, the housing 12 has an upper surface 16 that is generally planar. The binding machine 10 may optionally include a punch mechanism 18 for punching spaced perforations in a stack of paper sheets.

Figure 2:
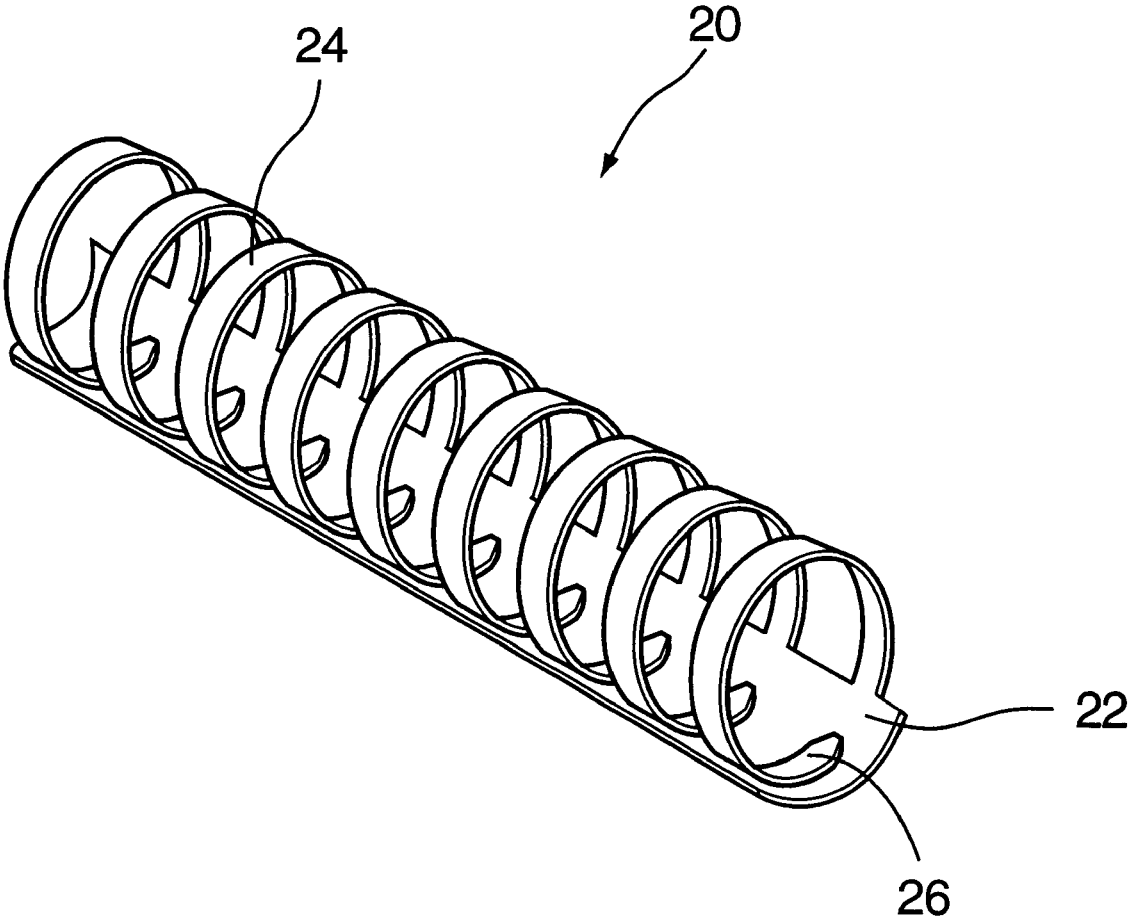
FIG. 2 is an isometric view of a conventional binding element which may be manipulated by the binding machine of the invention to bind together a stack of perforated sheets.

The binding machine 10 is operable to manipulate a conventional multi-ring binding element 20, such as that illustrated in FIG. 2 for binding together a stack of perforated sheets. The binding element 20 is typically made of resilient plastic. The binding element 20 has an elongate shape and includes an integrally-formed spine 22 and plurality of curl-shaped rings 24. The spine 22 runs along a length of the binding element 20, and the rings 24 extend laterally from the spine 22 at conventionally-spaced locations. Together, the spine 22 and rings 24 are curved so that the elongate binding element 20 has a generally cylindrical or tubular shape having a circular or oval cross-section. It is noted that the rings 24 are not continuous annular members, but rather, each ring 24 has one end connected to the spine 22 and an opposite free end 26 which is insertable through a perforation in a stack of sheets when the ring 24 is deflected to an uncurled position. In most binding elements, the free ends 26 lie under the spine 22 when the binding element 20 is in its normal or relaxed position, as shown in FIG. 2, but binding elements are also known which have the rings and free ends that lie over an outer side of the spine.

Referring back to FIG. 1, the binding mechanism 14 includes a plurality of stationary hooks 30 and a shroud 32 having an upstanding comb member 34. The comb member 34 is adapted to support the spine 22 of the binding element 20 while the rings 24 are deflected and uncurled. Accordingly, the comb member 34 and comprises a plurality of parallel, upstanding, linearly arranged tines 36 which are mounted to, or integrally formed with, the shroud 32. These tines 36 are conventionally spaced from each other to alternatively fit between the rings 24 of the conventional binding element 20.

The hooks 30 are stationarily fixed to the base 40 and are linearly aligned so as to be parallel to the comb member 34. The binding mechanism 14 further includes a handle 38 which is accessibly located exteriorly of the housing 12 and is manually operable to move the comb member 34 relative to the stationary hooks 30, as explained below. The binding mechanism 14 may also be alternatively be provided with an electric motor (not shown) for automatically driving comb member 34 to move.

According to the invention, a ring-uncurling force is effected on the binding element by a motion of the comb member while the hooks remain stationary. This contrasts to conventional devices wherein the hooks move relative to a stationary comb member. Another aspect of the invention is that the motion of the comb member relative to the hooks is pivotal or rotational. The unique comb motion of the invention is achieved by the structure of the binding mechanism 14 illustrated in FIGS. 3–7. As will be explained in detail below with reference to FIGS. 3–7, in a preferred embodiment, the binding mechanism 14 of the invention is operable to move the comb member 34 in two stages: (1) an initial axial shifting motion which moves the binding element 20 to engage with the hooks, and (2) a rearward rotation or pivotal motion whereby the hook-engaged rings 24 are uncurled (FIG. 6).

Figure 3:
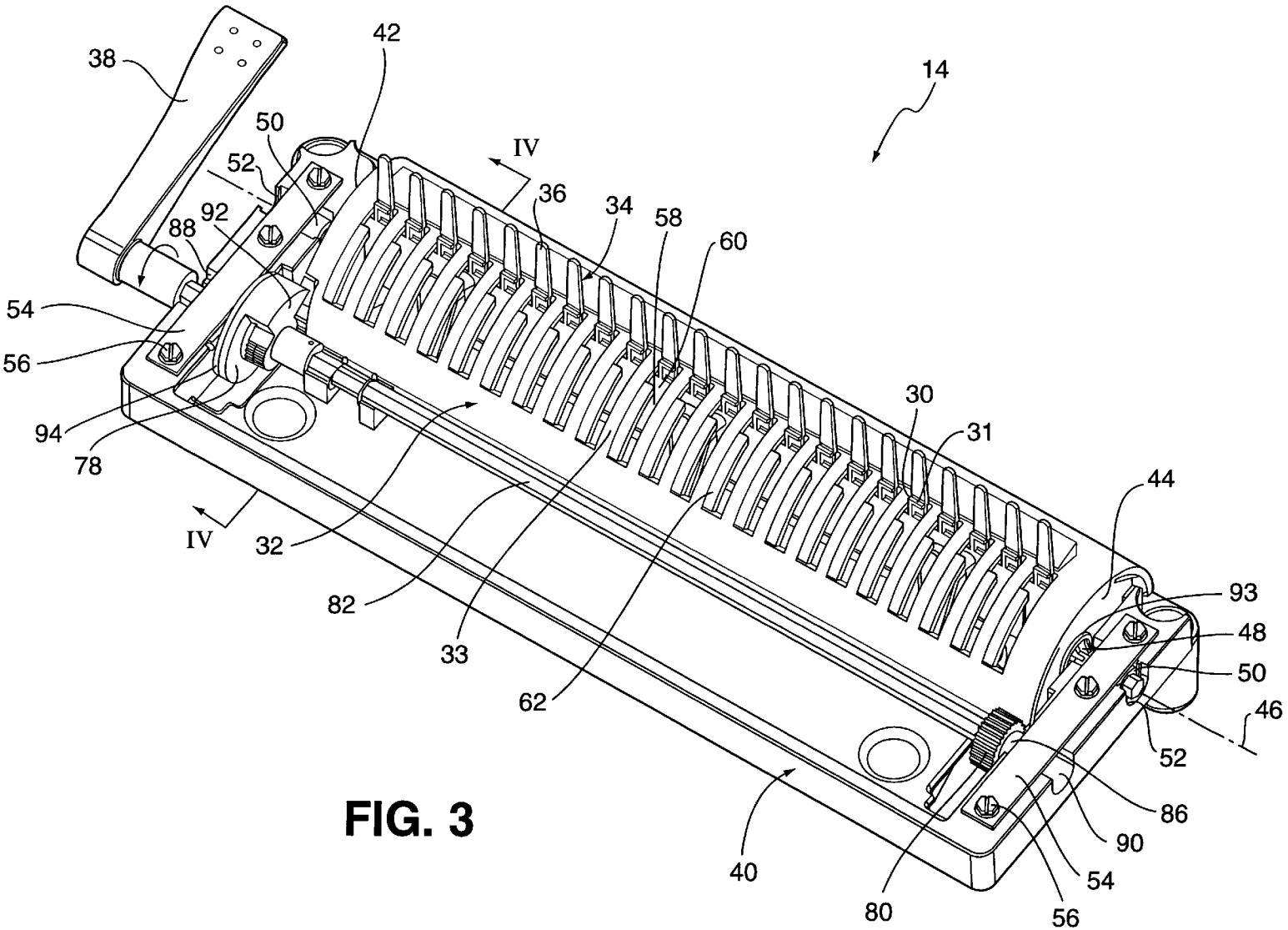
FIG. 3 is an isometric view of a binding mechanism from the binding machine of FIG. 1 in a closed position.
Figure 4:
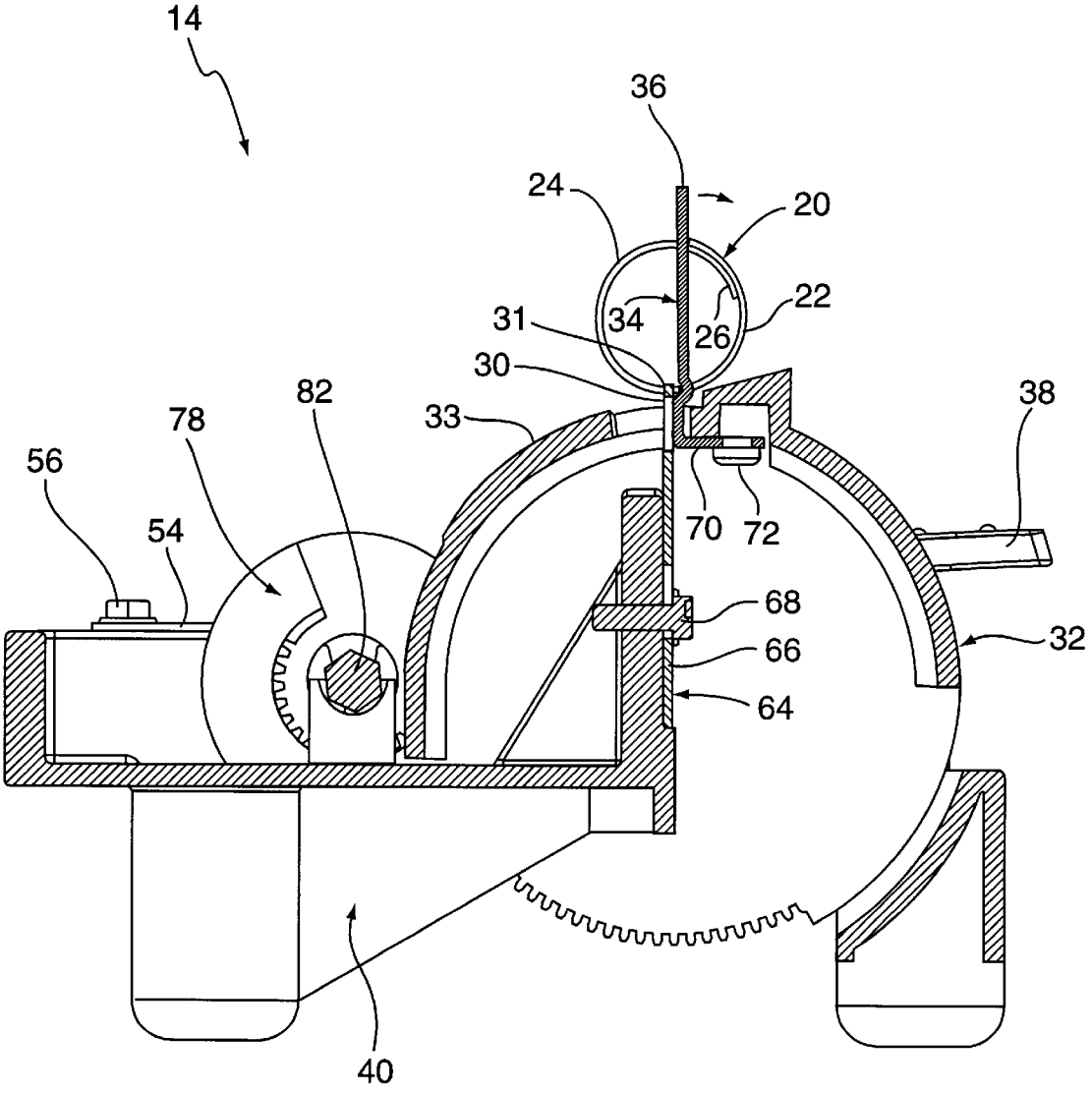
FIG. 4 is a side sectional view taken generally along line IV—IV of FIG. 3.
Figure 5:
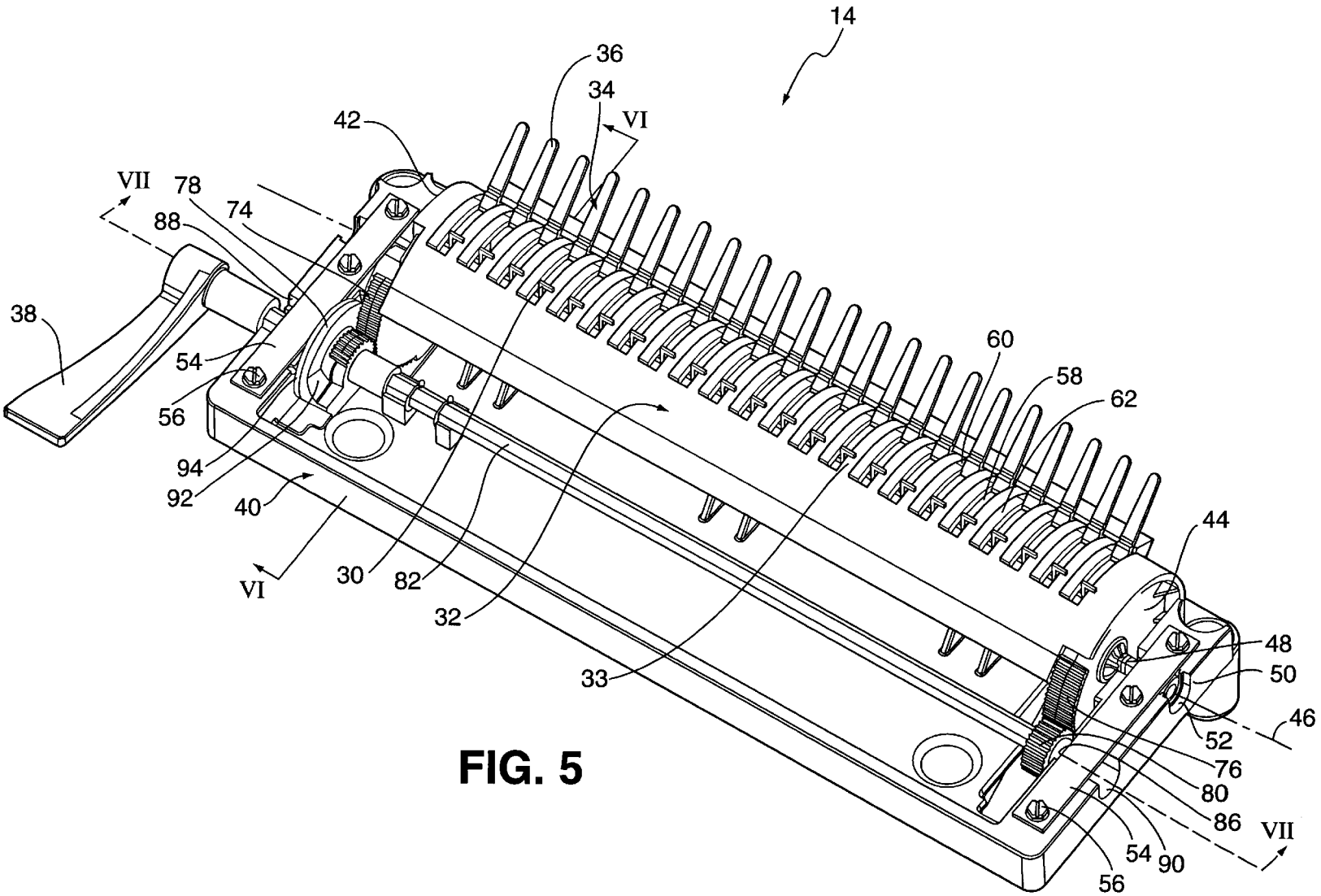
FIG. 5 is an isometric view of the binding mechanism of FIG. 3 in an open position.
Figure 6:
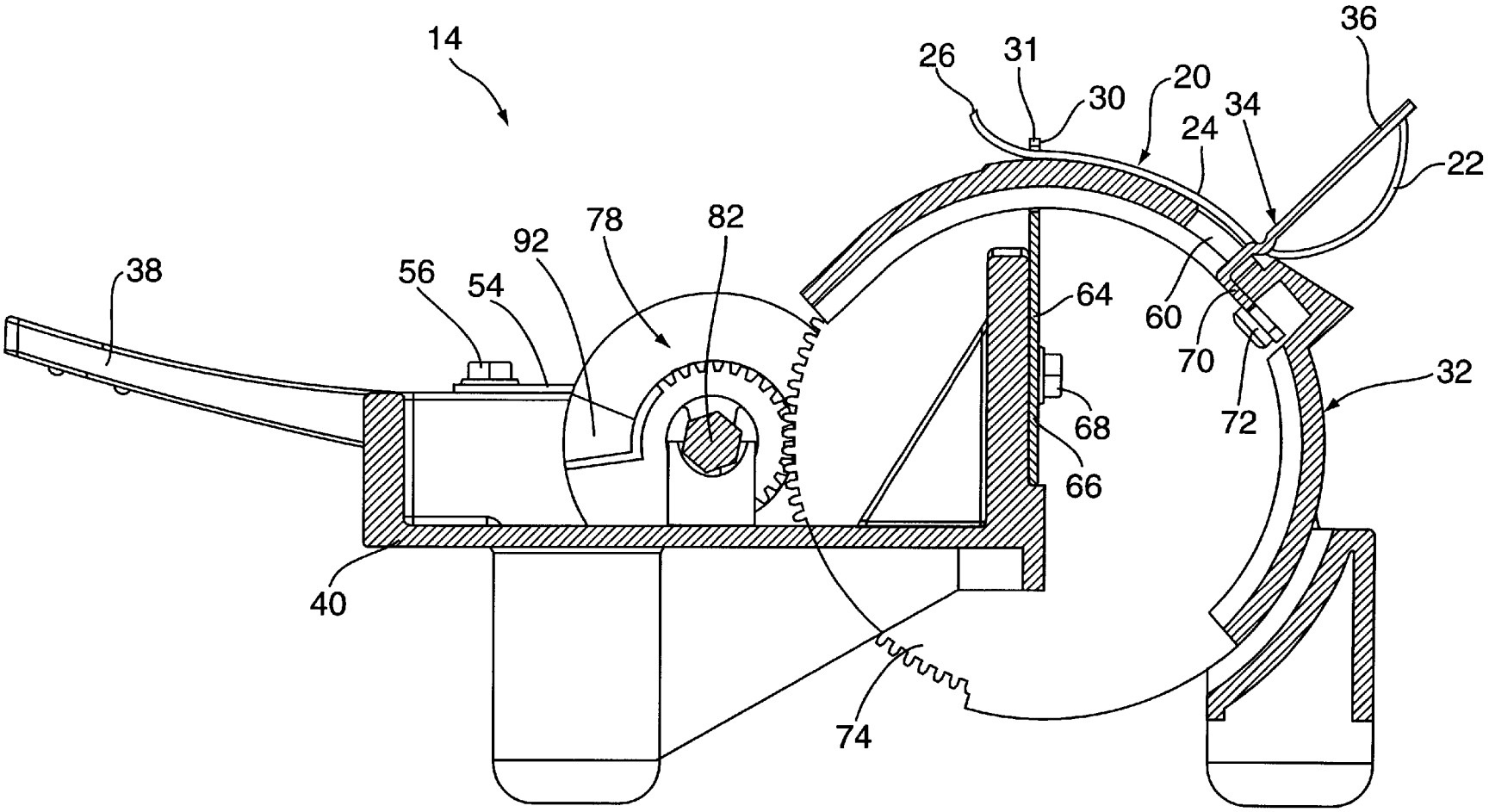
FIG. 6 is a sectional side view taken generally along line VI—VI of FIG. 5.

In general, FIGS. 3 and 4 illustrate the binding mechanism 14 in a "closed" position wherein the parallel comb member 34 and hooks 30 are close to each other, and FIGS. 5 and 6 illustrate the binding mechanism in an "open"

position wherein the comb member 34 has been rotated rearwardly away from the hooks 30. When the binding mechanism 14 is in the closed position, an operator initially positions the binding element 20 over the comb member 34 which receives the rings 24 alternatingly between the tines 36.

As shown in FIG. 4, the closed binding element 20 is positioned so that the spine 22 is positioned a rear side of the comb member 34 opposite the hooks 30 and so that the free ends 26 of the rings 24 are generally directed upwardly. Also at this initial position of the binding mechanism, the tines 36 are aligned respectively with the hooks 30 so that the rings 24 are received generally between the respective hooks 30 as well, but in an unengaged manner. The axial shifting motion of the comb member 34 then shifts the binding element 20 relative to the hooks 30 so that upper horizontal portions 31 (FIGS. 4 and 6) of the hooks 30 are positioned within the respective rings 30 near to a non-planar surface 33 of the shroud 32. The underside of the horizontal portions 31 of the hooks 30 and the non-planar surfaces 33 are preferably smooth and have low respective coefficients of friction.

When the binding mechanism 14 is operated to move toward the open position, the shroud 32 rotates or pivots rearwardly, as shown in FIGS. 5 and 6. Referring to FIG. 6, during the pivotal motion of the shroud 32, the tines 36 force the spine 22 of the binding element 20 rearwardly away from the stationary hooks 30. Because an inner side of each ring 24 is engaged under one of the hooks 30, the rings 24 slide under the hooks 30 and are forced to rollably uncurl to lie against the non-planar surface 33, as illustrated in FIG. 6. This deflection positions the free ends 26 in an accessible manner so that the operator may insert a perforated stack of sheets (not shown) onto the rings. The binding mechanism 14 is then moved back to the closed position shown in FIGS. 3 and 4, permitting the rings 24 to resiliently return to their original shape whereby the stack of sheets is then securely bound. The bound stack may then be lifted from the binding mechanism 14.

As shown in FIGS. 3–7, the binding mechanism 14 includes a sturdy frame-like base 40. The shroud 32 is pivotally mounted to the base 40 to facilitate the pivotal movement of the comb member 34. As illustrated in FIGS. 3–6, the shroud 32 is generally shaped as a partial cylinder or Quonset shape (see FIGS. 3–6) with generally flat ends 42, 44 (see FIGS. 3 and 5). The shroud 32 is mounted to pivot along an axis 46.

According to an aspect of the invention, the shroud is non-planar in shape, having a surface contour that is at least partially convex in shape to achieve a desired corresponding non-flat deflection of the rings. This contour results in a tendency of the free ends to angle forwardly during deflection of the rings to facilitate easier sheet insertion. This feature is advantageous over conventional binding machines in which the rings are deflected to lie against a planar surface, requiring a greater length of the rings to be uncurled to achieve a desirable forwardly angled position of the free ends.

Specifically, on the shroud 32 illustrated in FIGS. 3–6, the non-planar surfaces 33 have a contour that is radially curved in a convex manner to form a generally uniform radial profile during pivoting (see FIG. 6). The radially-curved profile of the non-planar surfaces 33 is centered on the axis 46.

It is noted, however, that the surfaces 33 is not limited to a radial shape, as described above. Rather, the surfaces 33 can be provided in numerous non-planar shapes contours can be provided according to the invention in order to achieve a desired ring deflection behavior. For example, the surface 33 could be shaped to have one or more crests, undulations, bumps, ripples, or projections, and may even include one or more planar surfaces, such as a hex-shape. Of course, where the contour of the surface 33 has a dramatic or abrupt shape, the uncurled portion of the rings 24 do not necessarily contact against the entire area of the surface 33 over which the ring 24 is uncurled. Additionally, each surface 33 could be formed of a series of elements or surfaces separated by gaps to form a desired general contour.

Figure 8:
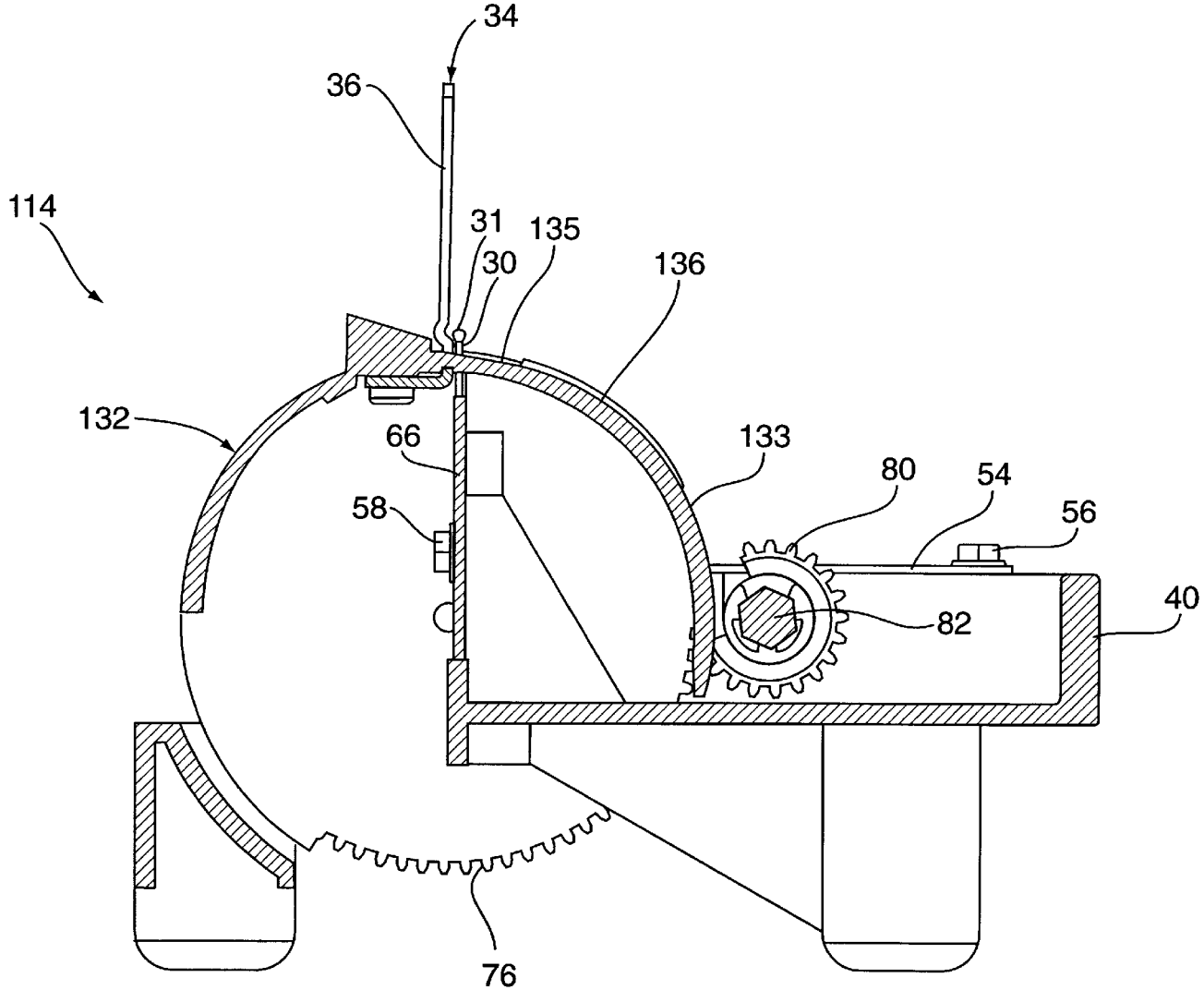
FIG. 8 is a sectional side view of a binding mechanism according to an alternative embodiment of the invention having a non-planar surface which has a convex section and a concave section.

FIG. 8 illustrates an example binding mechanism 114 including a shroud 132 having a plurality of non-planar surfaces 133, each of which has a contour with a first portion 135 that is radially curved in a convex fashion, and a second portion 136 that is radially curved in a concave fashion. It has been found that such a contour helps prevent overdeflection of the rings 24 beyond their elastic limit. According to the invention, any non-planar overall surface contour can be provided in order to achieve a desired ring-uncurling motion and material behavior, including various surface shapes and curvatures. Additionally, the non-cylindrical and non-planar surfaces according to the invention (such as those illustrated in FIG. 8) can provide advantageous ring deflection behavior regardless of the type of mechanism employed to spread the comb member from the hooks. For example, a binding mechanism constructed in accordance with this aspect of the invention may have a stationary comb member and movable hooks.

For pivotal support of the comb member 34, as shown in FIGS. 3 and 5, a pair of axially-mounted axles 48 are integrally formed with the shroud 32, one at each of which the flat ends 42, 44. The axles 48 respectively fit in a pair of rotatable bearings 50 held in the base 40. The bearings 50 are configured to permit axial and rotational movement of the axles 48. Each of the bearings 50 may be positioned in cooperatively-shaped recess 52 formed in the base 40 and held in place by a retaining strap 54 which is secured to the base 40 across the recess 52 in an appropriate manner, such as by screws 56.

Permitting a desired shroud motion without interference, the shroud 32 has a plurality of slots 58 through which the non-pivoting hooks respectively protrude. These slots 58 are shaped accommodate the respective hooks 30 during the range of both axial and rotational shroud movement. Accordingly, as shown in FIGS. 3 and 5, each of the slots 58 is generally elongate and circumferentially-oriented to accommodate a respective hook 30 during the rotational shroud motion, but each of the slots 58 also has a widened portion 60 to accommodate the hook 30 during the axial shroud motion.

The non-planar surfaces 33 for supporting the rings 24 during uncurling are formed on the shroud 32 between the slots 58. As described above, the non-planar surfaces 33 are arcuate or radially curved so that the rings 24 are deflected in a rolling, curved manner, but the surfaces 33 may be provided with some other non-planar contour as well. As explained above in connection with FIG. 6, when the shroud 32 and comb member 34 are pivoted toward the open position, rings 24 of the binding element 20 are caused to uncurl and lie against these respective surfaces 33.

Preferably, the shroud 32 also includes a plurality of raised ribs 62 which respectively extend adjacently to the slots 58 in the circumferential direction. Each raised rib 62 is positioned alongside an adjacent one of the ring-uncurling surfaces 33, aiding to guide the uncurled rings 24. It has been found that the ribs 62 substantially improve uniformity of position among the deflected rings 24, being particularly effective to maintain alignment of the free ends 26 when the binding element 20 is spread open.

As shown the sectional views of FIGS. 4 and 6, the plurality of hooks 30 may be formed as a unitary hook member 64 having a lower portion 66 secured to the base 40 by bolts 68 generally under the shroud 34. Additionally, the comb member 34 may be unitarily formed. As also shown in FIGS. 4 and 6, the comb member 34 has an L-shaped lower ledge 70 which secured to an inner side of the shroud 32 in an appropriate manner, such as by screws or rivets 72.

The shroud 32 is rotationally drivable by a gear-like structure. In particular, as best shown in FIG. 5, the shroud 32 includes a pair of geartooth sections 74, 76 respectively formed at opposite ends 42, 44 of the shroud 32. Driving the shroud 32 to rotate, the geartooth section 74 is engagable by an enmeshed cam gear 78 and the geartooth section 76 is engaged by an idler gear 80. The cam gear 78 and idler gear 80 are secured to a rod 82 which is rotatably mounted to the base 40 parallel to the axis 46 of shroud rotation. As shown, bearing surfaces 84 (FIG. 7) and 86 are respectively formed on the cam gear 78 and the idler gear 80 each of which rides in a cooperatively shaped recess 88, 90 formed in the base 40. The rod 82 is retained relative to the base 40 by the retaining strap 54 which extends across the recesses 88, 90.

The handle 38 is fixed to one end of the rod 82 so that the rod 82 rotates when the operator manually pivots the handle 38, simultaneously causing the cam gear 78 and idler gear 80 to rotate. When the teeth of the cam gear 78 and idler gear 80 are engaged with the geartooth portions 74, 76 of the shroud 32, the rotation of the rod 82 in turn causes the engaged shroud 32 and comb member 34 to rotate. As illustrated, the handle 38 is shaped as a lever, however the handle 38 could be other shapes as well, such as a wheel or a knob (not shown) which is grippable for rotation. The handle 38 may be mounted to the rod 82 with an adjustable binder stop structure, such as that described in U.S. Pat. No. 5,419,668, mentioned above.

Alternatively, the binding mechanism 14 could include only one geartooth section, such as the geartooth section 74 of the shroud 32 driven by the cam gear 78, however, the illustrated dual-engagement embodiment is preferred because it promotes a more uniform distribution of pivoting force to the shroud 32, and hence to the comb member 34, minimizing torquing and twisting of the shroud 32 which could undesirably skew or misalign the tines 36 of the comb member 34.

Moreover, another alternative embodiment could provide means for rotating the shroud instead of the geartooth engagement. For example, an appropriate linkage or cam structure could be provided which is operable to move the shroud as desired.

The shroud 32 is caused to axially shift between an initial first axial position (FIG. 3) wherein the binding element is not engaged by the hooks and a second axial position wherein the hooks 30 respectively engage inner sides of the rings 24. Additionally, when the shroud 32 is in this initial first axial position, the geartooth sections 74, 76 are offset from the teeth of the respective cam gear 78 and idler gear 80, but when the shroud 32 is shifted to the second axial position (see FIG. 5), the geartooth sections 74, 76 are optimally positioned for engagement with the respective cam gear 78 and idler gear 80 to transmit a rotational driving force to the shroud 32.

The axial shifting motion of the shroud 32 between the first and second axial positions occurs by a camming action occurring during an initial rotational motion of the cam gear 78. More specifically, the cam gear 78 has a tapered portion 92 which is engageable against the end 42 of the shroud 32. When the handle 38 is in an initial position or home position as shown in FIG. 3, the tapered portion 92 of the cam gear 78 is rotated so that the tapered portion 92 displaces the shroud 32 to the initial axial position (toward the right of FIG. 3). When the handle 38 is rotated forwardly, the tapered portion 92 of the cam gear 78 disengages from the shroud 32, permitting axial movement of the shroud 32 toward the second axial position (to the left of FIG. 3). The shroud 32 is biased by a coil spring 93 (FIGS. 3 and 5) concentrically positioned over the axle 48 in compression between the base 40 and the flat end 44 of the shroud 32 to urge the shroud 32 to move toward the second axial position upon disengagement of the tapered portion 92.

Figure 7:
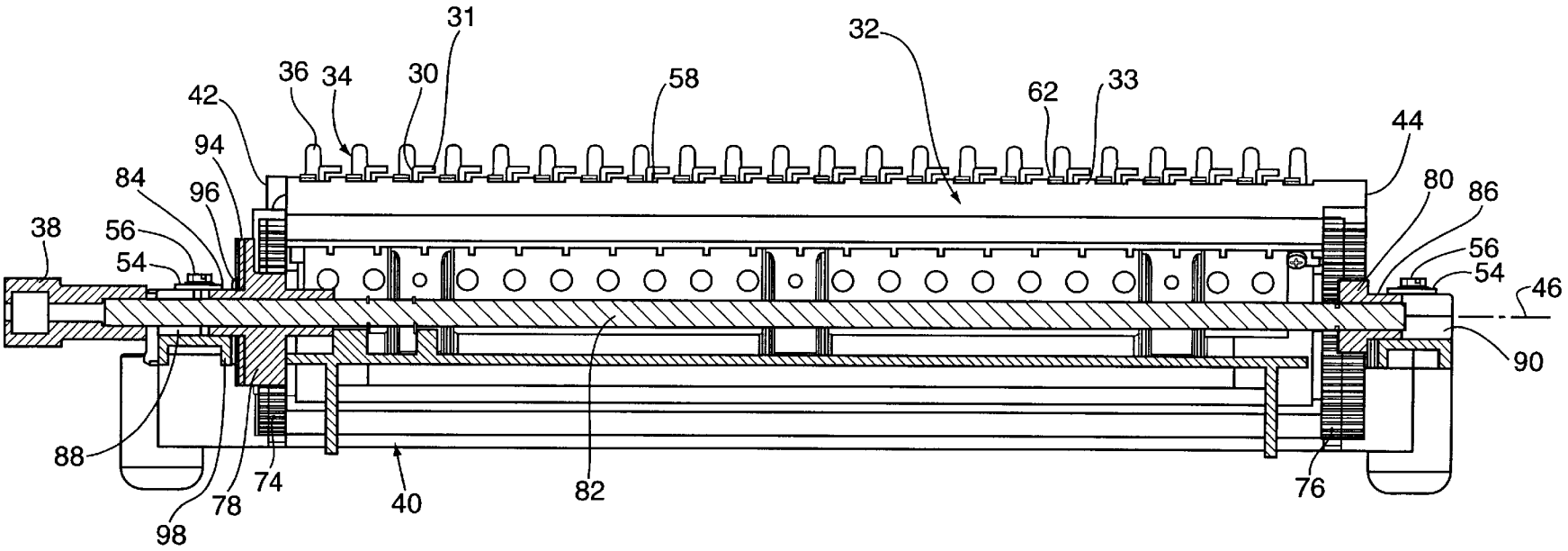
FIG. 7 is a sectional view taken generally along line VII—VII of FIG. 5.

Rotational resistance is provided to the rod 82 for holding the shroud 32 in a desired open position to permit the insertion of perforated sheets onto deflected-open rings 24 of a binding element 20. This resistance also enhances the control and "feel" of the binding mechanism 14 to an operator. Referring to FIG. 7, to provide this resistance, a washer-shaped friction plate 94 is disposed against the cam gear 78 facing the handle 38, and a wavy washer 96 is positioned in adjacent contact with the friction plate 94. The wavy washer 96 is held in compression between the friction plate 94 and a protrusion 98 of the base 40 with an amount of friction adequate to create a desirable frictional load against rotation of the rod 82.

For opening the binding element 20 to achieve the desired deflection behavior, the binding machine 10 may include various means for moving the comb member 34 relative to the hooks 30 so that the rings 24 are uncurled over a desired surface contour. In a preferred embodiment, the comb member 34 and hooks 30 are arranged to radially rotate or pivot relative to one another, so that they pull the rings with an arcuately pulling motion for an uncurling force. This is exemplified by the embodiment described in connection with FIGS. 1–8, but could also include a structure having a stationary comb member and pivotally-movable hooks, a structure wherein the comb member pivots rearwardly through extended slots in a stationary shroud, or a structure wherein the comb member and hooks both move relative to the stationary base. The latter, for example, is illustrated in FIG. 9.

Figure 9:
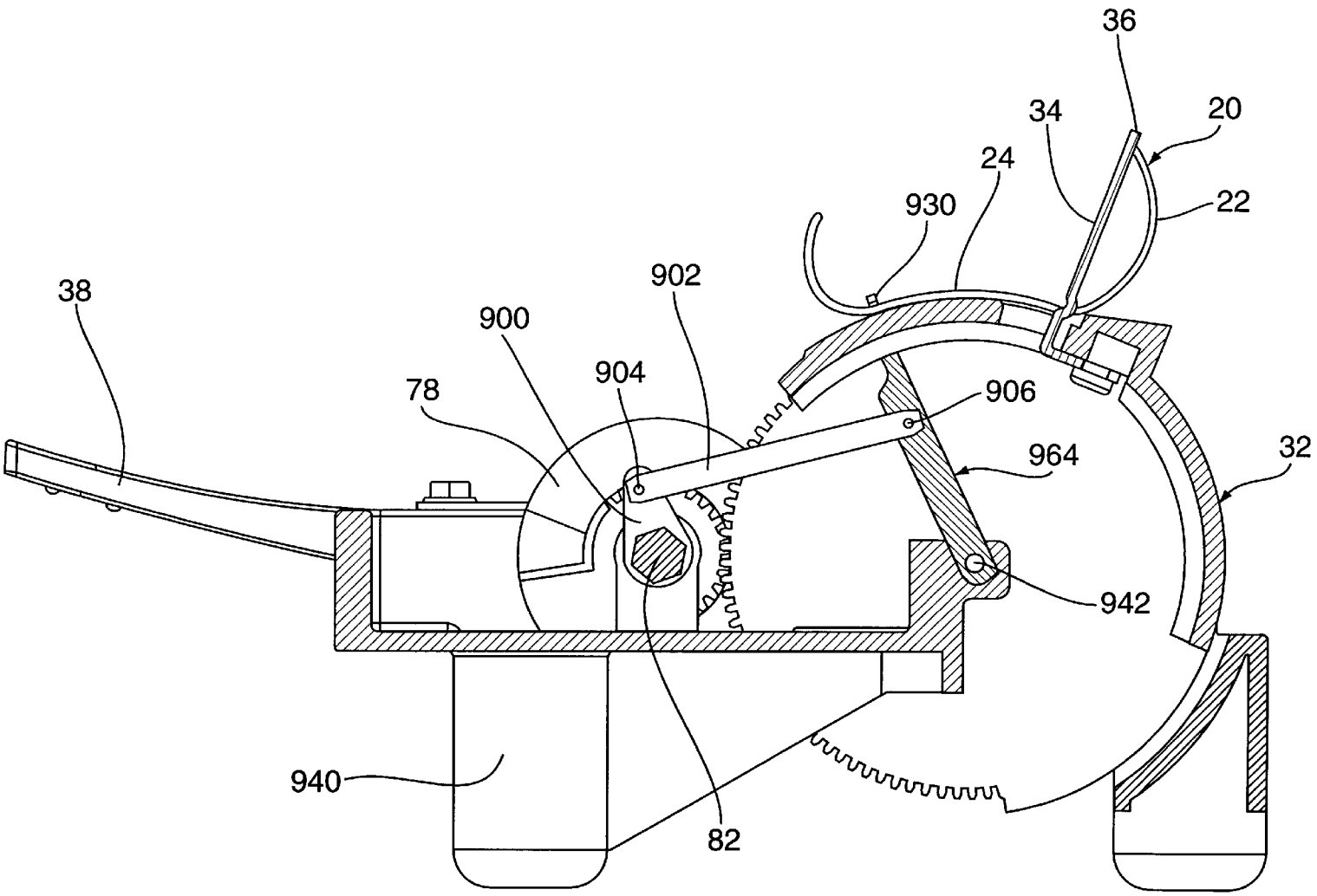
FIG. 9 is a sectional side view of a binding mechanism according to an alternative embodiment of the invention wherein both hooks and comb member are pivotable.

In the embodiment illustrated in FIG. 9, hooks 930 are pivotally movable in a forward direction while the comb member 34 is movable in a rearward direction. As shown, this dual-pivoting motion is achieved by a lever 900 mounted in a fixed manner on the rotatable rod 82 which is connected via a link 902 to a hingably movable hook member 964. The link 902 has opposite ends which a rotatably secured to the lever 900 and the hook member 964 by pins 904 and 906, respectively. The pivotable hook member 964 is mounted to a base 940 by a hinge 942. Like in the embodiments illustrated in FIGS. 1–8, the shroud 32 and comb member 34 are driven to rotate rearwardly by the geartooth engagement with the cam gear 78 upon rotation of the rod 82. As shown in FIG. 9, however, the rotation of the rod 82 also causes the lever 900 to rotate, thus pulling on the link 902 and, in turn, pulling the hook member 964 to move forwardly. This moves the hooks 930 and comb member 34 away from each other, causing the ring 24 of the binding element 20 to uncurl against the surface 33 of the shroud 34. Other alternative structures may be provided for pivoting the movable hooks 930 forwardly, such as appropriate gearing, cams or other linkages.

While the invention is described herein in connection with certain preferred embodiments, there is no intent to limit it to those embodiments. On the contrary, it is recognized that various changes and modifications to the described embodiments will apparent to those skilled in the art, and that such changes and modifications may be made without departing from the spirit and scope of the present invention. Accordingly, the intent is to cover all alternatives, modifications, and equivalents included within the spirit and scope of the invention as defined by the appended claims.

What is claimed is:

1. A binding machine for binding a stack of perforated sheets with a resilient binding element having an elongate spine and a plurality of curled ring members extending therefrom to respectively extend through perforations in the sheets, the machine comprising:

a base;

a plurality of stationary hooks fixed to the base; and a comb member mounted for pivotal movement relative to the base so that the pivotal movement is effective to deflectively open and close the rings of the binding element cooperatively engaged by the comb element and the hooks.

2. A binding machine according to claim 1, further comprising:

means for axially shifting the comb for selectively engaging and disengaging the hooks from the rings.

3. A binding machine according to claim 1, further comprising:

an elongated shroud, the comb member being fixed to move with the shroud, opposite ends of the shroud being rotatably mounted to the base for said pivotal movement.

4. A binding machine according to claim 3, wherein the shroud is radially curved and has a plurality of circumferentially-aligned slots through which said stationary hooks protrude during the pivotal movement of the shroud.

5. A binding machine according to claim 3, further comprising:

at least one geartooth section formed on said shroud;

a rotatable gear mounted to said base, the gear being drivably engagable with the geartooth element so that when the gear is engaged with the geartooth section, rotation of the gear causes said pivotal movement of the shroud.

6. A binding machine according to claim 5, wherein said binding machine includes at least two of said geartooth sections located at opposite ends of said shroud and at least two of said rotatable gears drivably engagable with the respective geartooth sections.

7. A binding machine according to claim 5, further comprising:

a handle pivotally mounted to the base and operatively linked to the gear so that pivoting movement of the handle causes rotation of the gear.

8. A binding machine according to claim 3, wherein the shroud is axially movable between an initial position and an axially shifted position.

9. A binding machine according to claim 8, further comprising:

biasing means urging the shroud toward said axially shifted position; and a cam mounted to the base to rotate between first and second positions, the cam having a tapered portion such that when the cam is in the first position the tapered portion engages the shroud to hold the shroud in the initial axial position against said urging, and such that upon rotation of the cam toward the second position the tapered portion disengages the shroud to permit the biasing means to axially shift the shroud toward the second axial position.

10. A binding mechanism for deflectively opening rings of a binding element to permit the insertion of a perforated stack of sheets onto free ends of the rings, the binding mechanism comprising:

a plurality of linearly arranged hooks for respectively engaging rings of a binding element;

a comb member having a plurality of linearly aligned tines parallel to the hooks, the tines being configured to support a spine of the binding element between the rings;

a plurality of non-planar surfaces positioned between the tines each of the non-planar surfaces having a first portion and a second portion, the second portion having a generally arcuate profile, the first portion being positioned between the comb member and the second portion, the first portion having a profile which is not continuous with that of the second portion; and means for moving the comb member relative to the hooks for uncurling the rings to lie against the non-planar surfaces.

11. A binding mechanism according to claim 10, wherein each of said second portions has a radially curved convex profile.

12. A binding mechanism according to claim 10, wherein each of said second portions has an arcuately-curved convex profile and each of said first portions has a radially concave profile.

13. A binding mechanism according to claim 10, further comprising a base, said hooks being stationarily fixed relative to the base, and said comb member being mounted to pivot relative to the base, said means being operable to pivot said comb member.

14. A binding mechanism according to claim 13, further comprising an elongate shroud pivotally mounted to move relative to the base, the comb member being fixed to the shroud.

15. A binding mechanism according to claim 14, wherein the non-planar surfaces are formed on the shroud.

16. A binding mechanism according to claim 15, wherein a plurality of slots are formed in the shroud between the respective non-planar surfaces, the stationary hooks extending through the slots.

17. A binding mechanism according to claim 16 wherein said shroud is movable along said axis.

18. A binding mechanism according to claim 14, wherein said shroud is mounted to pivot relative to said base along an axis parallel to the comb member and hooks.

19. A binding mechanism according to claim 10, further comprising a base, said hooks being mounted to pivot relative to the base, said means being operable to pivot said hooks.

20. A binding mechanism according to claim 10, further comprising a base, said comb member being mounted to pivot relative to said base, said hooks being mounted to pivot relative to the base, said means being operable to pivot said hooks and said comb member in opposite directions.

21. A method for binding a stack of perforated sheets with a resilient binding element having an integrally-formed spine and plurality of spaced rings, the method comprising the steps of:

positioning a binding element against a comb member having a plurality of spaced tines so that rings of the binding element are interpositioned between the tines;

engaging the rings against a plurality of respective stationary hooks; and pivoting the comb member away from the hooks to uncurl the rings.

22. A method according to claim 21, wherein the engaging step includes:

axially shifting the comb member to cause an axial shifting of the binding element so that the stationary hooks engage over an inner side rings respectively engage the plurality of stationary hooks.

23. A method according to claim 21, wherein the pivoting step includes deflecting each of the rings to lie against a respective non-planar surface.

* * * * *